United States Patent [19]

Kelch

[11] Patent Number: 4,577,683

[45] Date of Patent: Mar. 25, 1986

[54] HEAT EXCHANGER WITH SEPARATE HELICAL DUCTS

[75] Inventor: Heinz Kelch, Königsfeld, Fed. Rep. of Germany

[73] Assignee: Kienzle Apparate GmbH, Villingen-Schwenningen, Fed. Rep. of Germany

[21] Appl. No.: 614,447

[22] Filed: May 25, 1984

[30] Foreign Application Priority Data

May 28, 1983 [DE] Fed. Rep. of Germany ..... 3319521

[51] Int. Cl.[4] ..... F28D 7/10

[52] U.S. Cl. ..... 165/164; 165/170

[58] Field of Search ..... 165/164, 165, 170, 80 C

[56] References Cited

U.S. PATENT DOCUMENTS

| | | | |
|---|---|---|---|
| 1,961,660 | 6/1934 | Fehrmann | 165/170 |
| 2,005,515 | 6/1935 | Winkler | 165/166 X |
| 2,011,201 | 8/1935 | Rosenblad | 165/165 |
| 2,565,816 | 8/1951 | Jones | 165/164 |
| 3,330,334 | 7/1967 | Jansen et al. | 165/170 X |
| 3,921,713 | 11/1975 | Schnitzer et al. | 165/164 X |

FOREIGN PATENT DOCUMENTS

| | | | |
|---|---|---|---|
| 807939 | 4/1951 | Fed. Rep. of Germany | 165/165 |
| 2638492 | 3/1977 | Fed. Rep. of Germany | 165/164 |
| 88277 | 7/1921 | Switzerland | 165/164 |

OTHER PUBLICATIONS

IBM Technical Disclosure Bulletin, by R. R. Phinney, "Low-Gradient Anode Cooling Technique", vol. 13, No. 1, Jun. 1970, pp. 11-12.

*Primary Examiner*—Sheldon J. Richter
*Assistant Examiner*—Randolph A. Smith
*Attorney, Agent, or Firm*—Toren, McGeady, Stanger, Goldberg & Kiel

[57] ABSTRACT

A heat exchanger for indirect heat transfer between fluid media includes a duct member with the space in its interior divided by a separating wall extending transversely of the duct member axis into a pair of partial spaces. Webs located within the partial spaces and extending helically around the duct member axis form a pair of ducts in each partial space. One fluid medium is circulated through one duct and the other fluid medium through the other duct. The ducts in each partial space are interconnected by passages extending through the separating wall so that the fluid media flow through both partial spaces. The ends of the duct member spaced from the separating wall are closed by a combination seal and cover plate.

9 Claims, 2 Drawing Figures

HEAT EXCHANGER WITH SEPARATE HELICAL DUCTS

SUMMARY OF THE INVENTION

The present invention is directed to a heat exchanger for fluid media disposed in indirect heat transfer relation. The fluid media flows through ducts disposed in close thermal contact. The arrangement of the ducts affords an efficient heat exchanger construction.

There are a wide variety of heat exchangers in which indirect heat transfer is effected between fluid media, as well as heat exchangers where the heat transfer takes place between stationary media. Such heat exchangers are used in motors, compressors, pumps or in gear unit technology. Further, such heat exchangers are employed in oil-hydraulic and pneumatic drive, in brakes, in industrial processing and, of course, for cooling and heating purposes.

The basic conditions to be satisfied for the construction of a suitable heat exchanger have been known for a long time. In general, in designing a heat exchanger, the ratio of structural volume to heat exchanger surfaces must be kept as low as possible, that is, the structure of the heat exchanger must be as compact as possible with the lowest possible pressure losses.

To-date, the constructional optimization of such a heat exchanger with respect to the known basic conditions and also with regard to versatility of use and minimum manufacturing costs has not been achieved in the required consistent manner, because such heat exchangers were considered as a secondary unit, that is, as a necessary evil and not as an independent product.

For instance, there is a known heat exchanger in which the housing has inlet and outlet openings for the flow of the heat transfer media with the openings extending transversely relative to the housing axis. One heat transfer medium flows over a tube bundle which is located within and extends in the axial direction of the housing. Further, inlet and outlet openings are provided into the tubes forming the bundle. In another heat exchanger type, such as disclosed in the German Auslegeschrift No. 31 07 141, a double tube heat exchanger is provided, that is, one tube within the other, with one of the heat transfer media flowing in the space between the two tubes and the other medium flowing in the inner tube with the tubes forming a coil.

Such constructions are expensive to manufacture and assemble and, as a result, best suited for small-scale production, particularly because they require unusual manufacturing operations which are, in part, very different from one another in the same product, but are also unwieldy and bulky in handling at the installation site, because of their unfavorable shape and in certain installations, such as in motor vehicles, they are susceptible to vibration and do not correspond to the technical form expected from an independent product. In addit functional defects develop, especially in the second-named type due to uncontrollable cross-section contractions during the production of the double-tube coil.

Therefore, it is the primary object of the present invention to provide a heat exchanger in which such defects are avoided and where, to do justice to the broadest range of applications, the present invention offers an increased output performance compared to the prior art and also mass production where the heat exchanger can be produced as a cast member which can be mechanically assembled.

In accordance with the present invention, a single part duct member encircles a generally central axis and the duct member is in the shape of a frame. The space within the duct member is divided by a separating wall extending transversely of the axis into two substantially disc-shaped partial spaces. Each partial space is divided into a pair of helically wound ducts by webs extending perpendicularly to the separating wall. Two passages extend through the separating wall each connecting a different pair of ducts in the partial spaces. The opposite ends of the duct member are in the form of flanges disposed in parallel relation to the separating wall and a large area seal and cover member is assigned to each flange to form a closure for the partial space located between the flange and the separating member.

Another advantageous feature of the present invention is the provision of inlet and outlet openings through the duct member into the ducts within the partial spaces so that the axes of the openings extend parallel to the separating wall. Further, the seal and the cover plate are constructed as a composite part.

In accordance with the present invention, complicated housing shapes are avoided, that is, an extremely simplified structural arrangement of the heat exchanger is achieved and, in addition, the heat exchanger construction has a favorable configuration and is easy to install. Expensive manufacturing and assembly operations, such as soldering, bending and the like, are avoided and the heat exchange unit can be mass produced in a favorable manner and can be mechanically assembled.

Therefore, it is particularly significant that to complete the heat exchanger only two plate-like covers or end walls with intermediate seals need to be secured on the duct member. The duct member can be produced as a single monolithic part by injection molding or die-casting. In this arrangement there is the advantage that the loss of heat to the outside by radiation and heat conduction is negligible. It is not necessary to use a highly temperature conductive material for the transfer of heat, rather the largest possible surface,contact along the duct walls over which the two media flow is important. Though the heat exchanger can be produced from a suitable plastics material in certain applications, the use of such material has led to the optimization of the structural space/heat exchange surface transfer relation, that is, for a given thermal efficiency, a heat exchanger with a small duct cross-section can be utilized and, as a result, a surprisingly small sized heat exchanger can be produced. By using helical ducts for the flow of the transfer media in which boreholes and faulty cuts are avoided, the heat exchanger construction in accordance with the present invention affords extensively laminar flow of the two media and ensures relatively low pressure losses. Moreover, in accordance with the present invention, a battery arrangement is suitable with which the pressure losses can be further reduced.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
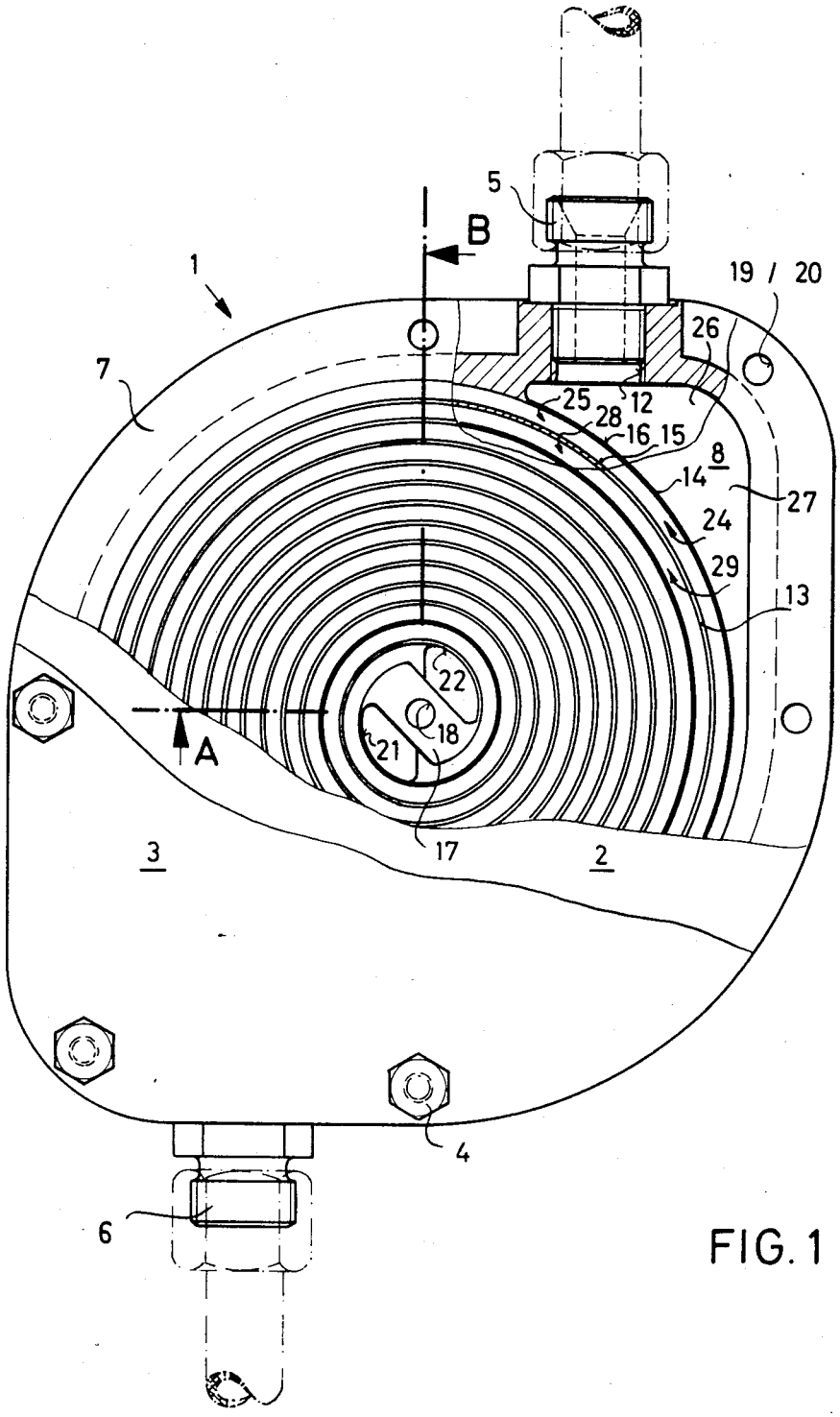
FIG. 1 is an elevational view, partly in section, illustrating the heat exchanger embodying the present invention.

In FIG. 1 a duct member 1 is shown defining an enclosed space with a generally central axis and closed at the opposite ends extending transversely of the axis by a seal 2 and a cover plate 3 securely fastened to the duct member 1 by suitable bolt members to provide a leakproof construction. Several bolt members 4 are shown in FIG. 1. Four threaded inserts 5,6 are used, however, only two are illustrated, and they serve to attach the heat transfer fluid media tubes to the duct member 1. The connection of the tubes is provided by a sleeve nut which, along with the tubes, are illustrated in dot-dash lines for the sake of completeness.

Figure 2:
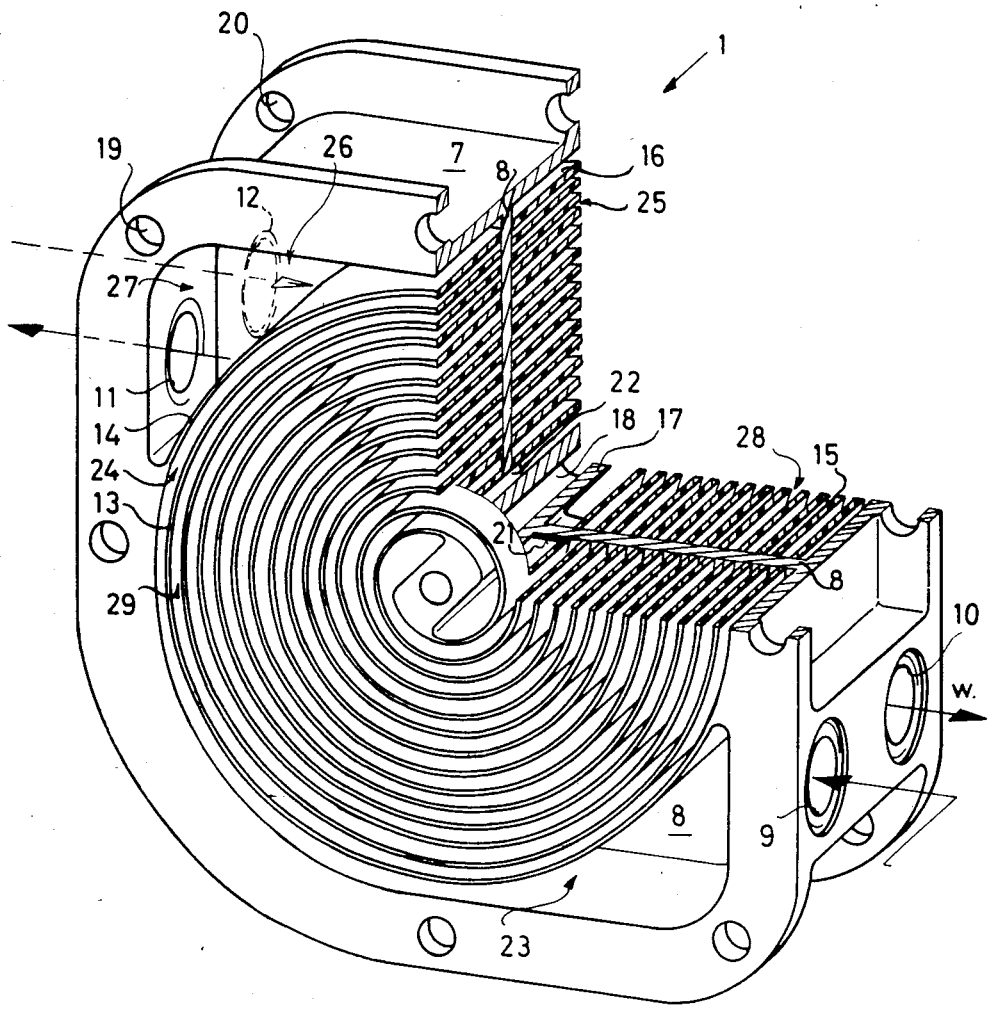
FIG. 2 is a perspective view of the duct member partly in section along the lines A-B in FIG. 1.

The duct member 1 shown in more detail in FIG. 2, is formed by a U-shaped frame 7 laterally enclosing the heat transfer space. The outstanding legs of the U-shaped frame form a pair of opposite flanges and the bight portion of the frame, extending between the flanges, defines the outer surface of the heat transfer space. As can be seen in FIG. 2, a separating wall 8 located on a central plane of the frame 7 divides the heat transfer space within the frame into two partial spaces so that each partial space extends from one of the opposite sides of the separating wall 8 to the end of the heat transfer space defined by the outer plane of the frame flanges. Each partial space has a pair of threaded boreholes 9,11; 10,12 and the threaded inserts 5,6 are secured within the boreholes. The threaded boreholes 9,11; 10,12 are constructed advantageously with their axes extending in planes parallel to the separating wall 8 so that the heat exchanger has a flat structural shape with a relatively easy and simple assembly of the connections to the heat exchanger being provided. Within each partial space, two spaced thin-walled webs 13,14 and 15,16 are provided with the starting points of the webs being located approximately 180° apart around the duct member 1. Accordingly, the thin-walled webs are located on both sides of the separating wall 8 and extend perpendicularly relative to the separating wall, as can be viewed in FIG. 2. Each pair of webs 13,14 and 15,16 commence at the frame and extend in a helically wound arrangement after a number of turns to an inner core 17 located along the central axis of the duct member 1. A central opening 18 is formed in the core 17 for an additional connection bolt securing the cover plates and seals on the duct member. Though not shown in detail, the openings 19,20 in opposite flanges of the frame 7 are arranged to receive the bolts for assembling the parts of the heat exchanger into a unit. In the core 17, passages 21 and 22 extend through the separating wall 8 and interconnect the inner ends of the ducts. In other words, passage 21 connects a duct on one side of the separating wall 8 to a duct on the other side of the separating wall. Similarly, passage 22 connects a different one of the ducts on one side of the separating wall to a different one of the ducts on the other side of the separating wall. Accordingly, a continuous flow arrangement is provided first through one duct in one of the partial spaces and then through the corresponding duct in the other partial space. The flow of the fluid media through the heat exchanger will be described in more detail as follows based on FIG. 2, that is, where the duct member 1 is shown open or with the seals 2 and cover plates 3 removed.

For example, if the higher temperature fluid medium is connected to the inlet opening 9, this medium, which is to be cooled, flows into a chamber 23 within the duct member 1 formed between the inside surface of the frame 7 and the radially outer surface of the web 13. As viewed in the clockwise direction the chamber 23 narrows into a duct 24 between the frame and the radially outer surface of the web 13. Approximately diagonally opposite the inlet opening 9 the web 14 forms a continuation of the inside surface of the frame 7 and extends helically around the space within the frame. The combination of the helically wound webs continues inwardly and finally ends in the passage 21 within the core 17. Accordingly, the fluid medium which is to give up heat has completed its passage through one partial space and flows through the passage 21 into the other partial space and enters the duct 25 located on the opposite side of the separating wall 8. In this other partial space, the ducts 25 and 28 are defined between the helically wound webs 15,16. Accordingly, duct 25 forms a continuation of the duct 24. In the second partial space, the fluid medium which releases its heat flows through the duct 25 outwardly toward the frame 7 until it reaches the outlet opening 10 located on the opposite side of the separating wall 8 from the inlet chamber 23. This outlet chamber is not shown in detail. Similarly, the cooler fluid medium, that is, the one which is to receive heat from the fluid medium flowing into the inlet opening 9, passes through the inlet opening 12 so that the flow of the fluid media is effected in counterflow. The cooler fluid media flows from the inlet chamber 26, diagonally opposite and similar in function to the inlet chamber 23, and enters into the other duct 28 within the partial space also containing the duct 25. Duct 28 is also defined by the helically wound webs 15,16. The cooler heat transfer medium flows through the duct 28 along a helical path and in close contact with the surface of the web separating the ducts 25 and 28. When the fluid medium reaches the inner end of the helically extending duct 28 it flows into the passage 22 where it is guided in the direction of the central axis into the other partial space so that it can flow in the outward direction through the duct 29 also formed by the webs 13 and 14. In this partial space the ducts 24 and 29 are arranged helically in an alternating manner so that effective heat transfer can be gained between the two heat transfer media. After completing its outward flow through the duct 29 the heat transfer medium which absorbs heat flows into the chamber 27 on the opposite side of the separating wall 8 from the chamber 26 and then through the outlet opening 11.

As can be seen in FIG. 2 the edges of the webs 13,14 and 15,16 spaced outwardly from the separating wall 8 are located in the same plane as the outwardly facing surfaces of the flanges of the frame 7 and these edges of the webs and the surface of the flanges lie in the same plane with the seals 2 which, in combination with the cover plates 3, cover and seal the chambers and ducts within each of the partial spaces. The seals 2 can be molded on the cover plates 3 so that a seal 2 and a cover plate 3 form a composite member.

While the embodiment described and illustrated is formed by two partial spaces separated by the separating wall 8, it would also be conceivable that the duct member 1 forms a single space of a possibly deeper construction. Such an arrangement would require a relatively bulky construction, since two connections for the heat transfer media would have to be positioned extending perpendicularly to the end surfaces of the duct member, that is, generally parallel to the central axis of the duct member.

Further, in a technical reversal of the arrangement shown in the illustrated embodiment, two housing shells could be joined together to form the two partial spaces within the duct member 1 with a suitable seal forming a partition between the two housing shells. A disadvantage of such an arrangement, however, is that two mirror-inverted forms are required if, as in the case described above, the helically extending ducts should extend congruently in the assembled state.

While specific embodiments of the invention have been shown and described in detail to illustrate the application of the inventive principles, it will be understood that the invention may be embodied otherwise without departing from such principles.

I claim:

1. A heat exchanger for indirect heat transfer between fluid media flowing in ducts disposed in close thermal relation, comprising a duct member extending around a generally central axis and laterally enclosing a space, said duct member having a pair of opposite ends extending transversely of the central axis, first means extending transversely of the central axis of said duct member and spaced in the axial direction of said duct member from the opposite ends thereof for dividing said space into a first partial space and a second partial space, second means extending transversely of said first means for dividing each of said first and second partial spaces into a first duct and a separate second duct each having a pair of opposite ends within each of said first and second partial spaces, third means extending in the axial direction of and spaced inwardly from said duct member between said first partial space and said second partial space for affording a flow connection between the first ducts in said first and second partial spaces and between the second ducts in said first and second partial spaces, fourth means extending transversely of the central axis of said duct member and across each of the opposite ends of said duct member for forming a sealed closure for each of said first and second partial spaces, said second means comprises a pair of webs helically wound in each of said first and second partial spaces and extending from adjacent said duct member around said central axis inwardly toward said central axis, one of the opposite ends of each of said first and second ducts being located adjacent said duct member and the other located at said third means, and an inlet member for said first ducts connected to the said duct member and opening into said first partial space and an outlet member for said first ducts connected to said duct member and opening from said second partial space, an inlet member for said second ducts connected to said duct member and opening into said second partial space and an outlet member for said second ducts connected to said duct member and opening from said first partial space for flowing the fluid media therethrough so that it passes through said first and second ducts in each of said first and second partial spaced in counterflow relation.

2. A heat exchanger, as set forth in claim 1, wherein said duct member is a monolithic member having a U-shape in axial section with said U-shape having a pair of spaced legs forming the opposite ends of said duct member and a bight portion extending between said legs and laterally enclosing said first and second partial spaces.

3. A heat exchanger, as set forth in claim 2, wherein said legs are in the form of flanges extending outwardly from said bight portion and spaced openings being located through said flanges, and connection means extending through the openings in said flanges for securing said fourth means to said duct member.

4. A heat exchanger, as set forth in claim 1, wherein said first means comprises a separating wall extending transversely across said duct member in a plane centrally located between the opposite ends of said duct member for dividing the space within said duct member into said first and second partial spaces each of approximately equal volume.

5. A heat exchanger, as set forth in claim 1, wherein said third means comprises a core section extending the direction of the central axis of said duct member and spaced radially inwardly from said duct member, said first and second ducts in each of said first and second partial spaces extending helically between said duct member and said core member, said core member forming a pair of separate passages with each said passage extending from said first partial space into said second partial space, and one of said passages joining the first ducts within said first and second partial spaces and the other said passage joining the second ducts within said first and second passages.

6. A heat exchanger, as set forth in claim 1, wherein said fourth means comprises a first and a second seal member each extending across one of said opposite ends of said duct member, and a cover plate in contact with each said seal member and located on the side thereof outwardly from said space within said duct member so that each combination of said first and second seal member and cover plate forms a closure for one of the opposite ends of said duct member and also for the sides of said first and second ducts spaced in the direction of the central axis outwardly from said first means.

7. A heat exchanger, as set forth in claim 6, wherein said seal and said cover plate forming a closure are formed as a composite part.

8. A heat exchanger, as set forth in claim 1, wherein said inlet members and said outlet members are secured to said duct member so that said inlet and outlet members extend through said duct member transversely of the central axis thereof.

9. A heat exchanger, as set forth in claim 1, wherein said duct member is formed of a plastics material.

* * * * *